US009683814B2

(12) United States Patent
Dryer

(10) Patent No.: US 9,683,814 B2
(45) Date of Patent: Jun. 20, 2017

(54) MULTI-FUNCTION RADIO FREQUENCY (MFRF) MODULE AND GUN-LAUNCHED MUNITION WITH ACTIVE AND SEMI-ACTIVE TERMINAL GUIDANCE AND FUZING SENSORS

(71) Applicant: Raytheon Company, Waltham, MA (US)

(72) Inventor: Richard L. Dryer, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 278 days.

(21) Appl. No.: 14/659,111

(22) Filed: Mar. 16, 2015

(65) Prior Publication Data

US 2016/0273880 A1 Sep. 22, 2016

(51) Int. Cl.

| | |
|---|---|
| ***F41G 7/22*** | (2006.01) |
| ***F41G 7/30*** | (2006.01) |
| ***F42B 15/01*** | (2006.01) |
| ***F41G 7/00*** | (2006.01) |
| ***F42C 13/04*** | (2006.01) |
| ***F41G 3/14*** | (2006.01) |
| ***F41H 11/02*** | (2006.01) |
| *F42B 15/00* | (2006.01) |

(52) U.S. Cl.

CPC ..... *F41G 7/2286* (2013.01); *F41G 3/14* (2013.01); *F41G 7/008* (2013.01); *F41G 7/226* (2013.01); *F41G 7/2246* (2013.01); *F41G 7/30* (2013.01); *F41H 11/02* (2013.01); *F42B 15/01* (2013.01); *F42C 13/04* (2013.01); *F42C 13/045* (2013.01)

(58) Field of Classification Search

CPC ..... F41H 11/02; F42B 15/01; F42C 13/04; F42C 13/045; F41G 3/14; F41G 7/008; F41G 7/20; F41G 7/22; F41G 7/2246; F41G 7/226; F41G 7/2273; F41G 7/2286; F41G 7/30; F41G 3/02; F41G 3/147; F41G 7/2266; F41G 7/24; F41G 7/28; F41G 7/301; F41G 7/305; H01Q 25/02; G01S 13/86; G01S 13/88; G01S 13/883; G01S 13/003; G01S 13/02; G01S 13/06; G01S 13/46; G01S 13/48; G01S 13/66; G01S 13/72; G01S 13/723

USPC ..... 244/3.1, 3.11, 3.14, 3.15, 3.19; 342/62

See application file for complete search history.

(56) References Cited

U.S. PATENT DOCUMENTS

| | | | | |
|---|---|---|---|---|
| 2,969,018 A | | 1/1961 | Erst et al. | |
| 3,949,955 A | | 4/1976 | Sykes et al. | |
| 4,264,907 A | * | 4/1981 | Durand, Jr. | F41G 7/008 244/3.15 |
| 6,087,974 A | * | 7/2000 | Yu | F41G 7/2286 244/3.1 |

(Continued)

*Primary Examiner* — Bernarr Gregory
(74) *Attorney, Agent, or Firm* — Eric A. Gifford

(57) ABSTRACT

A multi-function radio frequency (MFRF) module integrates command guidance, active and semi-active terminal guidance (and possibly passive) and fuzing sensors for gun-launched munitions into a single assembly. The MFRF module can be incorporated into a variety of different gun-launched munitions to execute missions currently performed by guided missiles. The MFRF module is programmable during munition activation to select the guidance mode, active or semi-active, and a primary fuze mode, proximity or height of burst.

20 Claims, 6 Drawing Sheets

(56) References Cited

U.S. PATENT DOCUMENTS 6,114,984 A * 9/2000 McNiff ..... G01S 13/723 342/146
6,116,536 A * 9/2000 Williamson ..... F41G 7/2266 244/3.14
6,188,349 B1 * 2/2001 Spencer ..... F41G 7/2266 342/100
6,211,816 B1 * 4/2001 Westphal ..... F41G 3/02 342/357.24
6,313,784 B1 * 11/2001 Pittman ..... F41G 7/28 244/3.13
6,568,629 B1 * 5/2003 Perrin ..... F41G 7/28 244/3.11
6,727,843 B1 * 4/2004 Hansen ..... F41G 7/305 244/3.1
6,806,823 B1 10/2004 Smith et al.
6,952,179 B1 * 10/2005 Jones ..... F41G 7/008 244/3.15
7,019,684 B1 * 3/2006 Spencer ..... F41G 7/2266 342/100
7,151,478 B1 * 12/2006 Adams ..... F41G 3/147 244/3.1
7,545,312 B2 * 6/2009 Kiang ..... G01S 13/003 342/104
7,696,460 B1 * 4/2010 Spencer ..... F41G 7/2286 244/3.1
8,552,349 B1 * 10/2013 Alexander ..... F42B 15/01 102/200
2005/0012655 A1 * 1/2005 Lalezari ..... G01S 13/48 342/62
2012/0181374 A1 * 7/2012 Williams ..... H01Q 25/02 244/3.19

* cited by examiner

MULTI-FUNCTION RADIO FREQUENCY (MFRF) MODULE AND GUN-LAUNCHED MUNITION WITH ACTIVE AND SEMI-ACTIVE TERMINAL GUIDANCE AND FUZING SENSORS

BACKGROUND OF THE INVENTION

Field of the Invention

This invention relates to guided gun-launched munitions and more specifically to a multi-function radio frequency (MFRF) module that provides active and semi-active terminal guidance and fuzing sensors for gun-launched munitions.

Description of the Related Art

Gun-launched munitions are projectiles that are provided an initial velocity at launch (e.g. conventional gun powder or electromagnetic rail gun) and whose trajectory is subsequently governed by the laws of classical mechanics. Most gun-launched munitions achieve ballistic stability by spinning at a high rate. The rifling of the gun barrel imparts a spin to the munition when fired. The spinning projectile is stabilized by gyroscopic forces that resist perturbations. Other unguided munitions have airfoils that stabilize the munition's trajectory. The airfoils move the center of pressure of the munition aft of its center of gravity providing a static stability margin. The airfoils are also canted to impart a low spin rate, which minimizes the affects of non-uniform fabrication tolerance buildup.

These weapon systems are typically "fire and forget". The system computes a firing solution based on a ballistic trajectory to intercept the target. The firing solution is based on the best information available about the target (e.g. range, speed, direction), the environment (e.g. temperature, wind conditions etc.) and the projectile itself. The accuracy of such systems is limited by this knowledge and environmental stability.

Some gun-launched munitions provide for post-launch guidance of the munition. For sensor stability, guided munitions have a low to zero spin rate. Tail fins that are folded and deploy upon exiting the gun barrel provide stability and low-level spin control. Fine spin control and guidance control can be provided by the tail fins or a separate actuator such as canards, wings, reaction jets or impulse thrusters. These munitions are of "full caliber" having a maximum diameter equal to that of the barrel and tapering down to the front of the munition.

Raytheon Missile System has fielded a 155 mm extended range guided artillery shell known as the "M982 Excalibur". The M982 Excalibur uses GPS guidance and foldable airfoils that deploy upon leaving the barrel to guide the munition to pre-programmed GPS coordinates. The M712 Copperhead is a 155 mm caliber cannon-launched, fin-stabilized, terminally laser guided, explosive projectile intended to engage hard point targets such as tanks or self-propelled howitzers. Italian defence company Oto Melara has developed a 76 mm gun that fires a Driven Ammunition Reduced Time of Flight ("DART") muntion. The guidance system is Command Line of Sight (CLOS) from a transmit antenna on the gun to a data link antenna on the rear of the DART munition.

Some large caliber munitions such as the 155 mm (6.1 inch) munition contain an additional fuze assembly. The fuze assembly may include a mechanical sensor to detect impact, an electrical sensor to measure elapsed time or time delay or an RF sensor to measure Doppler/Doppler rate for proximity detonation or range-to-target for a Height of Burst detonation. The RF sensor includes a forward facing antenna and an RF transmitter/receiver to measure RF reflections off of the target to compute the Doppler/Doppler rate or range-to-target. In guided munitions, the fuze assembly is physically separate from and operates independently of the seeker and guidance assemblies. The fuze assembly must meet stringent safety requirements that preclude software. All fuze logic is implemented in firmware.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides a multi-function radio frequency (MFRF) module that provides command guidance, active and semi-active terminal guidance and fuzing sensors for gun-launched munitions.

The munitions include a plurality of airfoils deployed about a munition. The munition may be full-caliber and employ foldable airfoils that deploy as the munition exits the gun barrel. Alternately, the munition may be sub-caliber and employ pre-deployed airfoils. Sub-caliber munitions require a sabot for support in the bore of the gun barrel.

The munition includes at least one rear-facing antenna and at least four forward-facing antennas mounted to conform to the surface of the munition or airfoils. The munition further includes a guidance processor configured to process direction finding information and output a guidance command, a control system responsive to the guidance command to maneuver the projectile towards the target and a fuze processor configured to initiate detonation of the warhead. The control system may actuate the airfoils or employ a separate actuator such as canards, reaction jets or impulse thrusters to guide the munition towards the target.

In an embodiment, the MFRF module comprises a frequency synthesizer configured to generate an intermediate frequency (IF) signal, a transmitter configured to upconvert an input waveform from the IF to an RF frequency and to transmit the RF waveform from one or more of the forward-facing antennas, a multi-channel analog receiver, each channel coupled to a respective antenna to receive an RF signal and to downconvert the RF signal to an IF signal, amplify the signal and filter noise, an analog-to-digital converter configured to digitize the IF signals from the multiple receiver channels and an RF signal processor. The RF signal processor is configured to implement a command-guided mode to process the digital IF signal from the rear-facing antenna and output command guidance information to the guidance processor directly to the control system until target acquisition. The RF signal processor is configurable to implement any one of an active guidance mode in which the transmitter is activated and a semi-active guidance mode to process the digital IF signals (e.g. sum/delta processing) from the at least four forward-facing antennas and upon acquisition of the target to derive direction finding information towards the target until terminal. At terminal, the RF signal processor is configurable to implement either of a proximity and height of burst fuze modes by activating the transmitter at terminal and processing the digital IF signal from at least one of the forward-facing antennas to derive range-to-target or Doppler information. The MFRF module integrates both the terminal guidance modes and the fuzing sensors into a single unit for use with a gun-launched guided munition.

In an embodiment, the RF signal processor is configured for selection and storage of the guidance and fuze modes at munition activation just prior to launch. The processor is configured to support independent selection of either guidance mode and either fuzing sensor as the primary fuze mode.

In an embodiment, the RF signal processor is configurable to implement a passive guidance mode in which the target is actively emitting RF energy. The channels of the multi-channel analog receiver coupled to the at least four forward-facing antennas are configured to receive the actively emitted RF energy to support the more rigorous processing of the passive guidance mode.

In an embodiment, at least the frequency synthesizer, the transmitter, the multi-channel analog receiver and the analog-to-digital converter are implemented on a single board within the module. In an embodiment, a receiver channel (for rear-facing antenna), the synthesizer and the analog-to-digital converter are implemented on an aft-facing side of the board and four receiver channels (for the four forward-facing antennas) are implemented around the transmitter on a forward-facing side of the board.

These and other features and advantages of the invention will be apparent to those skilled in the art from the following detailed description of preferred embodiments, taken together with the accompanying drawings, in which:

DETAILED DESCRIPTION OF THE INVENTION

The present invention describes a multi-function radio frequency (MFRF) module that integrates command guidance, active and semi-active terminal guidance and fuzing sensors for gun-launched munitions into a single assembly.

The MFRF module can be incorporated into a variety of different gun-launched munitions to execute different missions currently performed by guided missiles. For example, an anti-cruise missile (ACM), anti-aircraft or anti-ship mission may use a munition with semi-active or active guidance with a proximity fuze. A mission to attack targets on the surface of land or water may use a munition with semi-active or active guidance with a height of burst fuze.

Depending upon the mission, a guided missile may include a data link for command guidance, an RF seeker that is configured to implement active or semi-active terminal guidance and a fuze assembly that includes a transmitter/receiver channel and logic to implement a proximity and/or height of burst fuze mode. Each assembly is a separate physical unit that functions independently. Each assembly is designed and configured for a particular mission. Missiles are typically several feet in length, several inches in diameter, several hundred or more pounds and expensive. As such, missiles can accommodate the volume and cost of the various seeker, guidance, control and fuze assemblies that are designed for a particular missile and mission. The Advanced Medium-Range Air-to-Air (AMRAAM) missile is an example of a missile that employs command guidance to target acquisition and active-mode guidance through terminal. The AMRAAM missile is 12 ft in length, 7 inches in diameter and weighs about 335 pounds.

Figure 1:
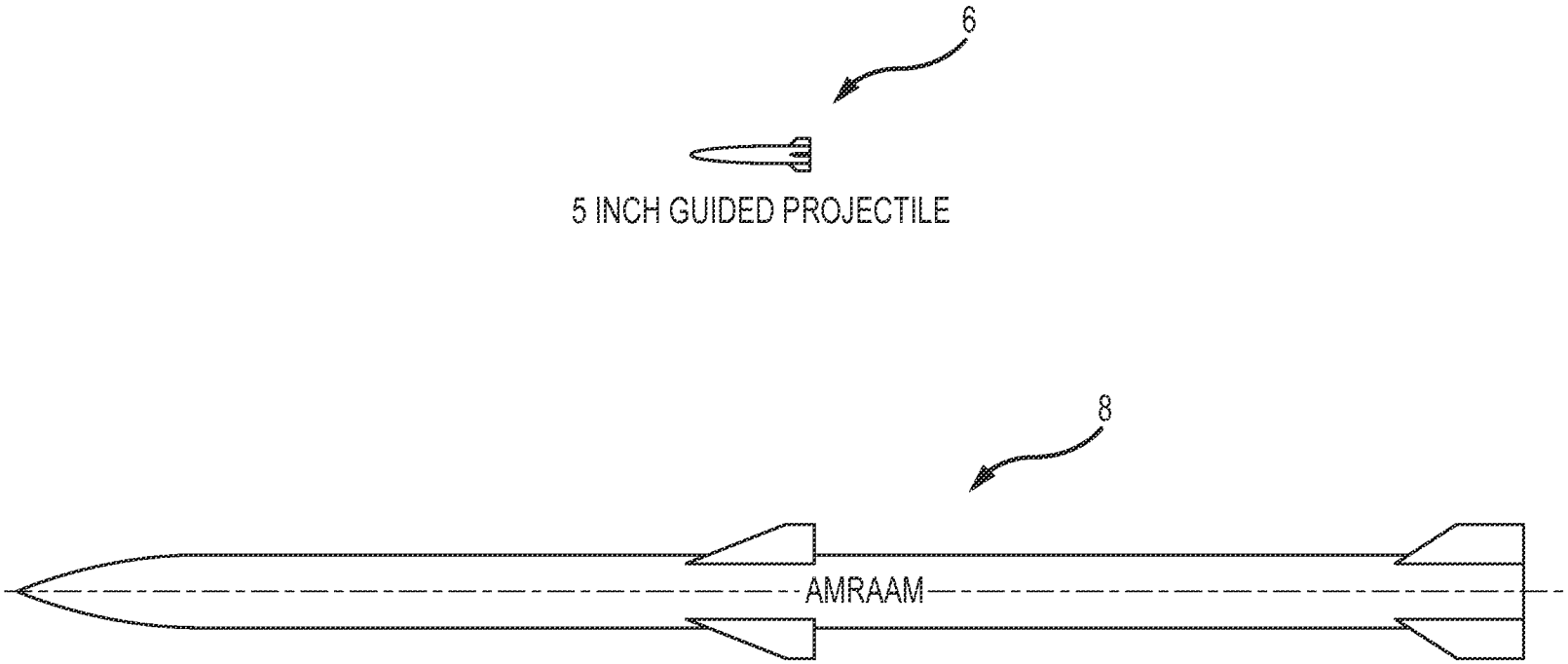
FIG. 1 is an illustration of a gun-launched RF guided munition and an RF guided missile.

By comparison gun-launched munitions are typically much smaller, at most the barrel diameter (typically 6 inches or less) in diameter, and usually less than 100 pounds at a much lower price point. A comparison of a gun-launched munition 6 and an AMRAAM missile 8 is depicted in FIG. 1. As such, gun-launched munitions do not have the volume to package all of the RF guidance capability of a missile in its current form factor. If the munition is sub-caliber, employing pre-deployed airfoils rather than foldable airfoils, the available package volume is reduced further exacerbating the problem. Furthermore, at the lower price point, gun-launched munitions cannot support one-off designs for each munition and mission.

The MFRF module addresses both the packaging and price point challenges by integrating the data link and fuzing sensors within the RF seeker and providing multi-mission guidance capability in a single module. Only the fuzing sensor functionality is integrated into the seeker module, thereby eliminating an additional antenna and a transceiver, which is critical in order to package all of the capability into the reduced volume provided by the gun-launched munition. The fuze logic remains implemented in firmware to meet the stringent safety requirements placed on the separate fuze assembly. The MFRF module includes a transmitter than can be used in either active guidance mode or either of the fuzing sensor modes. The MFRF module is programmable during munition activation to select the guidance mode, active or semi-active, and a primary fuze mode, proximity or height of burst. In some instances, the primary fuze mode may be an impact or time delay mode in which case neither of the support fuzing sensor modes is selected. The multi-mission MFRF module can be integrated into a number of different munitions to support a variety of munitions.

Figure 2:
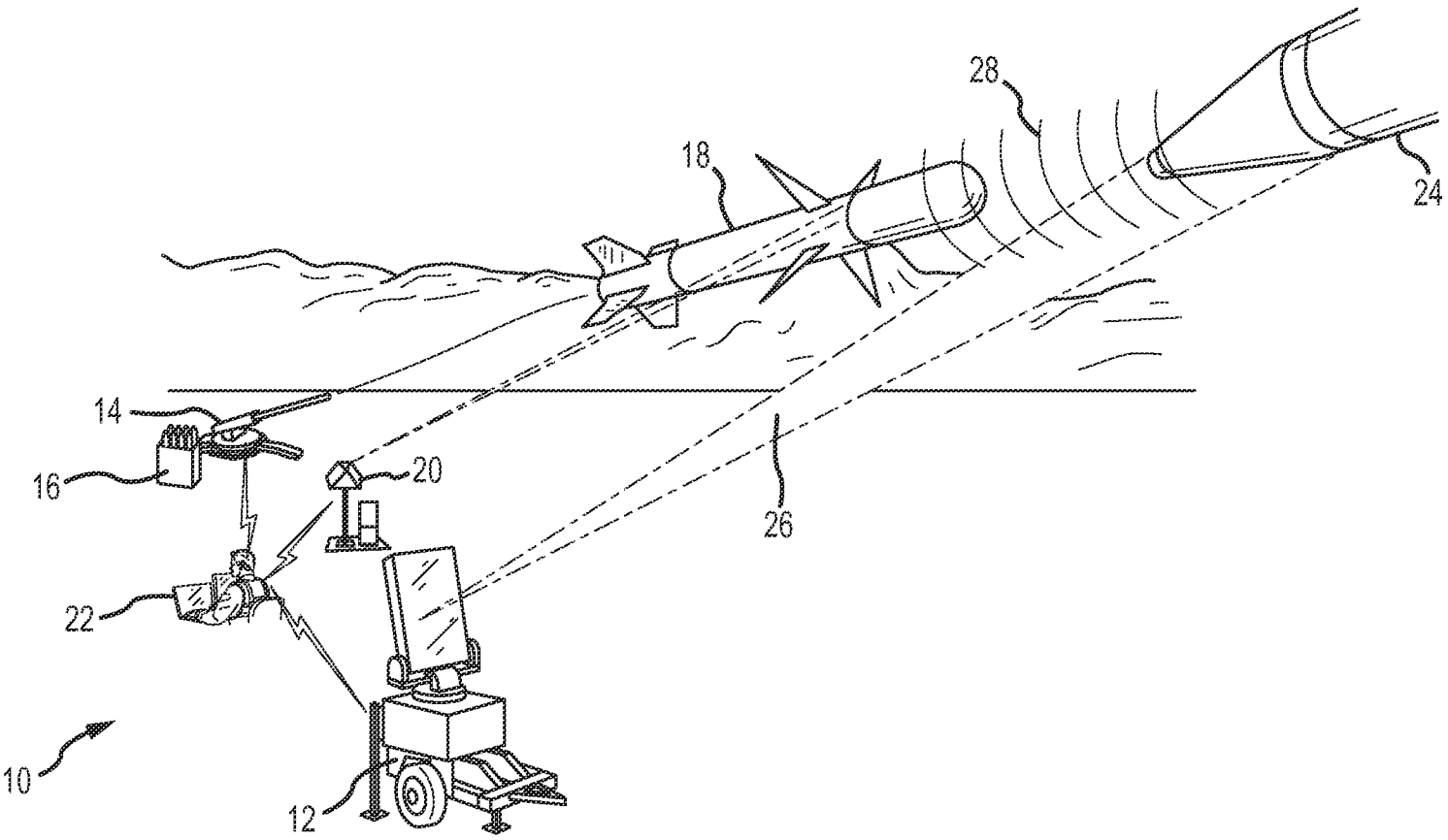
FIG. 2 is an illustration of an engagement scenario for a gun-launched RF guided projectile.

Referring now to FIG. 2, an embodiment of a gun system 10 includes a radar system 12, a gun 14, a store 16 of RF guided munitions 18, a data uplink 20 and a command station 22. During munition activation, typically just prior to firing, munition 18 is programmed to select either of an active or semi-active guidance mode and either of a proximity or height of burst primary fuzing mode depending on the mission. Radar system 10 illuminates a target 24 with pulsed RF energy 26 to detect, acquire and track target 24. Command station 22 issues a command to gun 14 to aim and fire a munition 18 to engage target 20. Command station 22 receives tracking updates from radar system 12 and transmits commands as RF signals via data link 20 to command guide munition 18 towards the target.

Munition 18 is configured to receive RF signal energy at four or more forward-facing locations. At some point in flight, munition 18 is in position to receive RF signal energy 28 reflected from target 24. The source of the RF signal energy may be the pulsed RF radiation 26 from radar system 12 (or another external source of RF radiation) to support the "semi-active" guidance mode or it may RF radiation from a transmitter on-board the munition to support the "active" guidance mode. The munition receives the RF energy, down converts it to an intermediate frequency (IF) signal, conditions (amplify the signal, reduce the noise) and then processes the IF signal from the four or more locations to acquire target 24. Upon acquisition, the munition processes the signals (e.g. sum/delta processing) to derive direction finding information (e.g. a line-of-sight (LOS) angle) to target 24 until terminal. The munition processes the directing finding information to generate a guidance command to maneuver the munition towards the target.

At a certain time to impact or detonation ("at terminal"), munition 18 assumes an unguided mode to allow body motion to settle out. During this settling out period, the fuze becomes active. The munition activates the transmitter to transmit RF signal energy and processes the received reflected RF signal energy from one or more forward-facing locations. In a "proximity" fuze mode, the munition derives Doppler information (e.g., Doppler and Doppler rate). In a "height of burst" fuze mode, the munition derives a range-to-target. Depending upon the primary fuze mode, the munition processes the Doppler information or the range-to-target to issue a detonation command to detonate the explosive warhead in proximity to the target. Most munitions will have a backup fuze mode that relies on an impact sensor.

Figure 3:
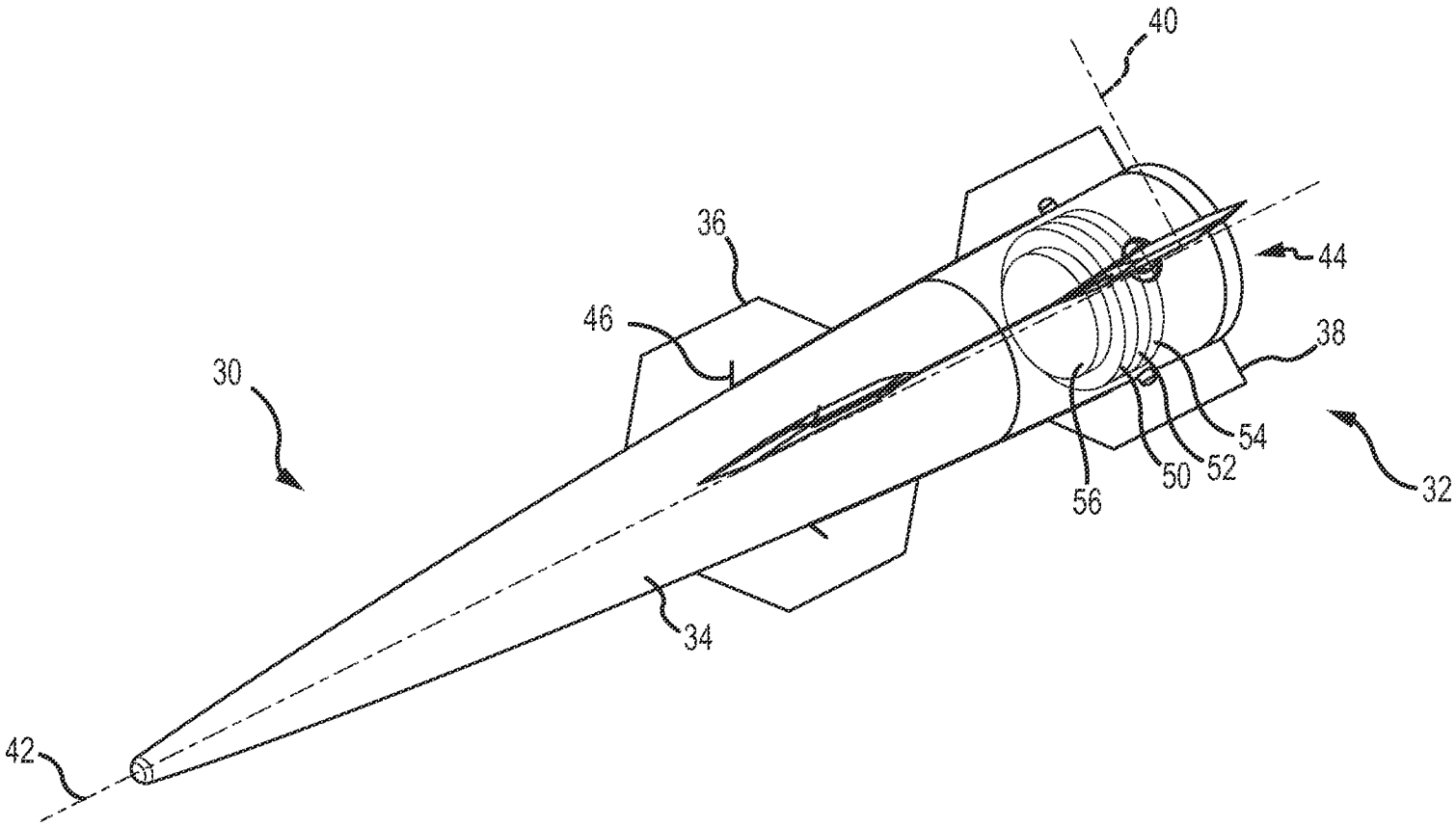
FIG. 3 is an illustration of an embodiment of a gun-launched RF guided munition including a multi-function RF (MFRF) module capable of supporting multiple terminal guidance and fuzing modes.
Figure 4:
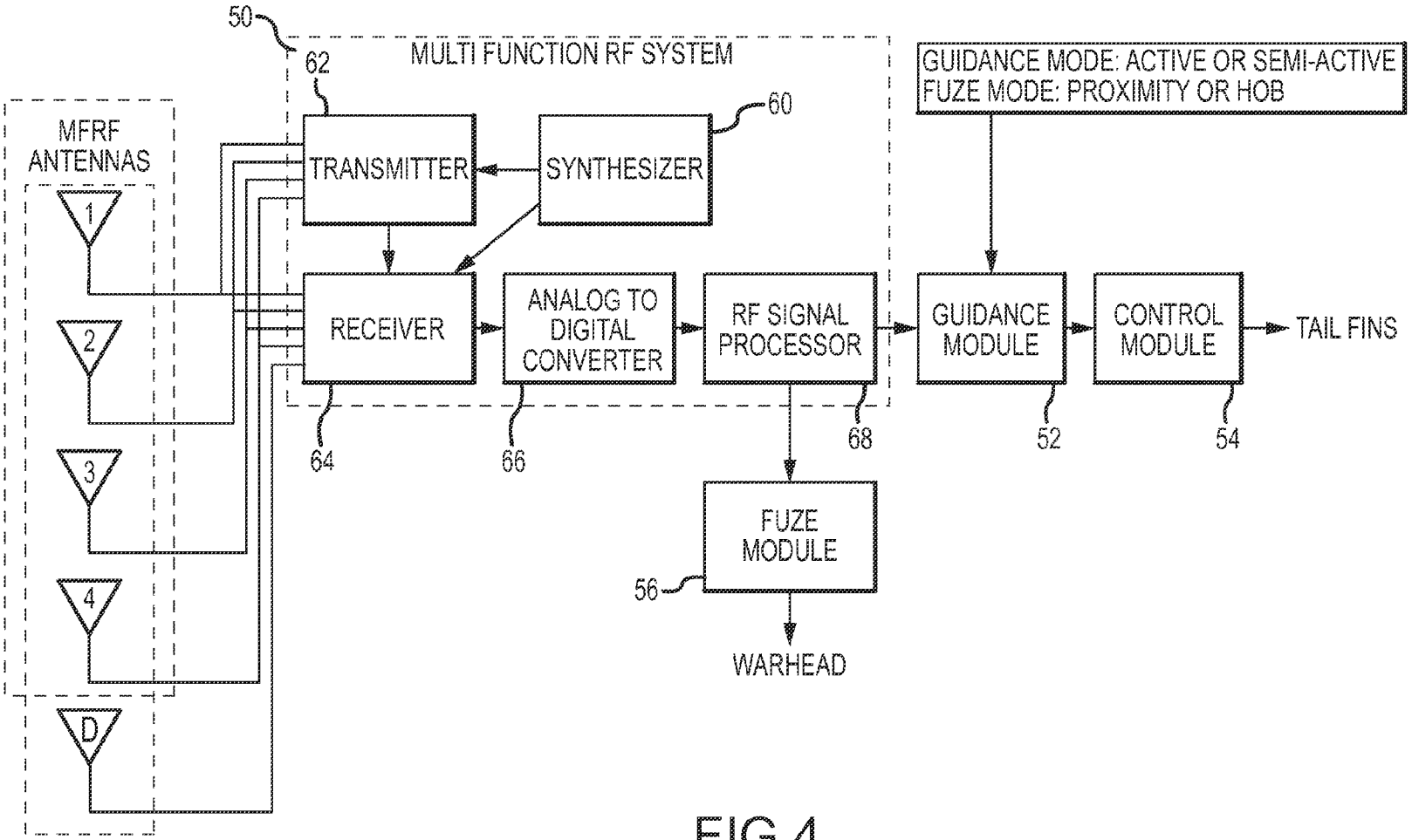
FIG. 4 is a block diagram of the gun-launched RF guided munition.

Referring now to FIGS. 3 and 4, in an embodiment a sub-caliber munition 30 includes a GNC (guidance, navigation & control) assembly 32 that is attached to the rear of an explosive warhead 34. For stability, the sub-caliber munition 30 includes four wings 36 mounted near the center of gravity (Cg) of the munition and four tail fins 38 mounted on the GNC assembly 32 aft of the Cg. Both the wings 36 and tail fins 38 are non-foldable airfoils. The wings 34 are fixed. The tail fins 36 can be actuated to rotate about axes 40 that extend radially from a longitudinal axis 42 of the munition. Such rotation can be used to provide fine stability control or to maneuver the munition. In other embodiments, a separate actuator such as canards, wings, reaction jets or impulse thrusters can be used to provide fine stability control or maneuverability.

Sub-caliber munition 30 includes a rear-facing data-link antenna 44 and four forward-facing antennas 46. The data-link antenna 44 is suitably a patch antenna that is mounted on the aft side of the GNC assembly 32. To withstand the g forces at firing and the thermal conditions of hypersonic flight, each of the forward-facing antennas 46 is formed conformal with a surface of the warhead 34 or one of the wings 36. These antenna may be horns, patches, trips, etc.

GNC assembly 32 houses four separate modules; a MFRF module 50 that integrates the data-link receiver, transmitter, multi-channel receiver and sum/delta processing for terminal guidance in either semi-active or active modes and fuzing sensors for proximity and height of burst fuze modes, a guidance module 52 that processed direction find information from the MFRF module to generate a guidance module, a control module 54 responsive to the guidance command to actuate tail fins 38 to maneuver the projectile towards the target; and a fuze module 56 that implements the fuze logic in firmware to process either the Doppler information or range-to-target information provided by the MFRF to initiate detonation of explosive warhead 34. If the fuze mode is a non-RF mode that is not supported by the MFRF module such as impact or time delay, neither fuze mode is activated within the MFRF module.

MFRF module 50 includes a synthesizer 60 that generates an intermediate frequency (IF) signal that is provided to a transmitter 62 and each channel of a multi-channel receiver 64. When activated, either in an active terminal guidance mode or at terminal in a fuzing sensor mode, transmitter 62 generates an signal that is directed to one or more of the forward facing antennas 46. Multi-channel receiver 64 includes a channel that is coupled to data-link antenna 44 to receive the command-guidance signal, down convert it to the IF, condition the signal to amplify the signal component and reduce noise. Multi-channel receiver 64 includes four channels that are coupled to respective forward-facing antennas 46 to receive energy reflected off of the target, down convert it to the IF, condition the signal to amplify the signal component and reduce noise. An analog to digital converter 66 digitizes the conditioned IF signals for each of the channels and an RF signal processor 68 processes the digitized IF signals.

If configured to implement command-guidance, the RF signal processor 68 will simply pass the signals through to the guidance module. The ground data link may send actual control commands in which case the signals can be passed directly to the control module. Alternately, the ground data link may send target and munition state information that the guidance module must process to generate the guidance commands.

During the initial flight, whether free-flying or command guided, the RF signal processor 68, once activated, will process the digitized IF signals from the four forward-facing antenna in an attempt to acquire the target in either a semi-active or active guidance mode. Upon acquisition of the target, the RF signal processor 68 processes the digitized IF signals to do derive direction finding information towards the target. The processor is suitably configured to implement a sum/delta technique that uses sums and differences of the four signals to derive a line of sight (LOS) angle to the target. Sum/delta processing is a well-established technique used in semi-active and active guidance in both laser and RF guided missiles.

At a certain time to impact or detonation ("at terminal"), the munition assumes an unguided mode to allow body motion to settle out. During this settling out period, the fuze module 56 becomes active. The MFRF activates transmitter 62 to transmit RF signal energy and processes the received reflected RF signal energy from one or more forward-facing locations. In a "proximity" fuze mode, the RF signal processor 68 derives Doppler information (e.g., Doppler and Doppler rate). In a "height of burst" fuze mode, the process derives a range-to-target. The sensor information is provided to fuze module 56 that implements the fuze logic to initiate detonation of the warhead.

The MFRF module 50 and munition 30 are suitably configured during munition activation just prior to loading the munition into the gun. A computer or other hand-held device is suitably connected through a port in the munition to interface with guidance module 52. A user can select active or passive guidance mode and select a proximity, height or burst or other fuze mode. The other fuze mode allows for the option of using a fuze such as an impact sensor instead of one of the RF fuze sensors. The MFRF module provides the flexibility to configure the muntion for many different mission scenarios.

Figure 5:
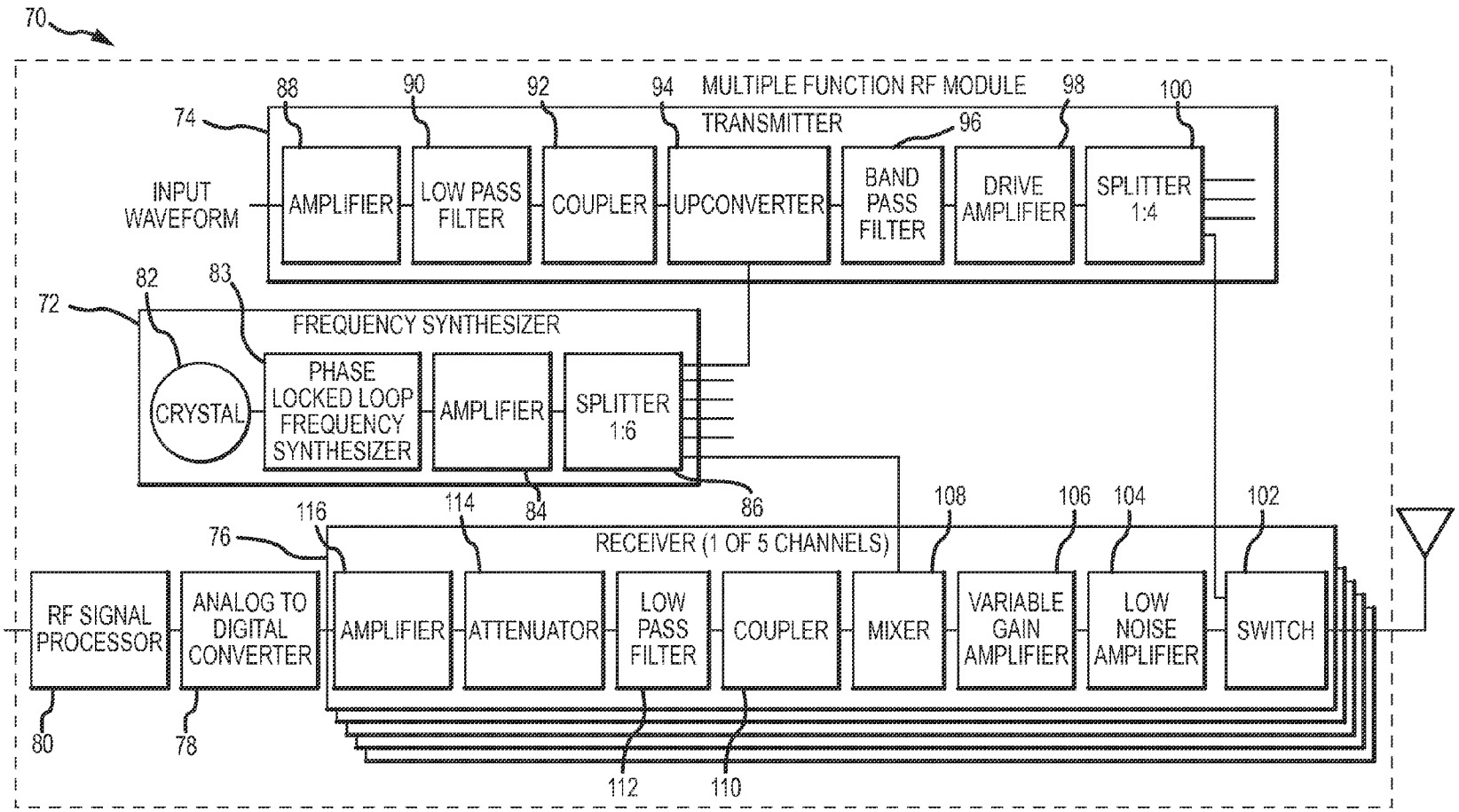
FIG. 5 is a detailed block diagram of an embodiment of the MFRF module.

Referring now to FIG. 5, an embodiment of an MFRF module 70 includes a synthesizer 72, transmitter 74, a multi-channel receiver 76, an analog to digital converter 78 and an RF signal processor 80. Synthesizer 72 includes a crystal oscillator 82 and phase locked loop (PLL) frequency synthesizer 83 that generate an IF signal. An amplifier 84 amplifies the IF signal and a 1:6 splitter 86 splits the IF signal into 6 IF signals; one for the transmitter and one each for the five receiver channels.

Transmitter 74 receives an input waveform, amplifies the waveform (amplifier 88), low pass filters the waveform (LPF 90) remove high frequency noise, couples the waveform (coupler 92) through a low noise unity amplifier that provides isolation and uses the IF signal to upconvert the waveform (upconverter 94) to an RF signal in the appropriate frequency. The transmitter band pass filters the RF waveform (BPF 96), amplifies the RF waveform (Drive amplifier 98 and splits the RF waveform into 4 RF signals (1:4 splitter 100). In this embodiment, the RF waveform is switched through one or more of the receiver channels to the forward-facing antennas.

Multi-channel receiver 76 is in effect a multi-channel frequency down converter and low noise amplifier. Each channel includes a switch 102 to switch the transmitter or the receiver channel to the antenna. Each receiver channel amplifies the RF signal by a fixed gain (low noise amplifier 104) to amplify the received signal and a variable gain (variable gain amplifier 106) to match the amplitude of the signal to a common range. The normalized RF signal is mixed with the IF signal (mixer 108) to downconvert the signal to the IF. This signal is coupled (coupler 110) through a low noise unity amplifier that provides isolation. The IF signal is low pass filtered (LPF 112) to reduce noise, normalized (attenuator 114) and amplified (amplifier 116) to the input range of analog to digital converter 78.

Figures 6A, 6B:
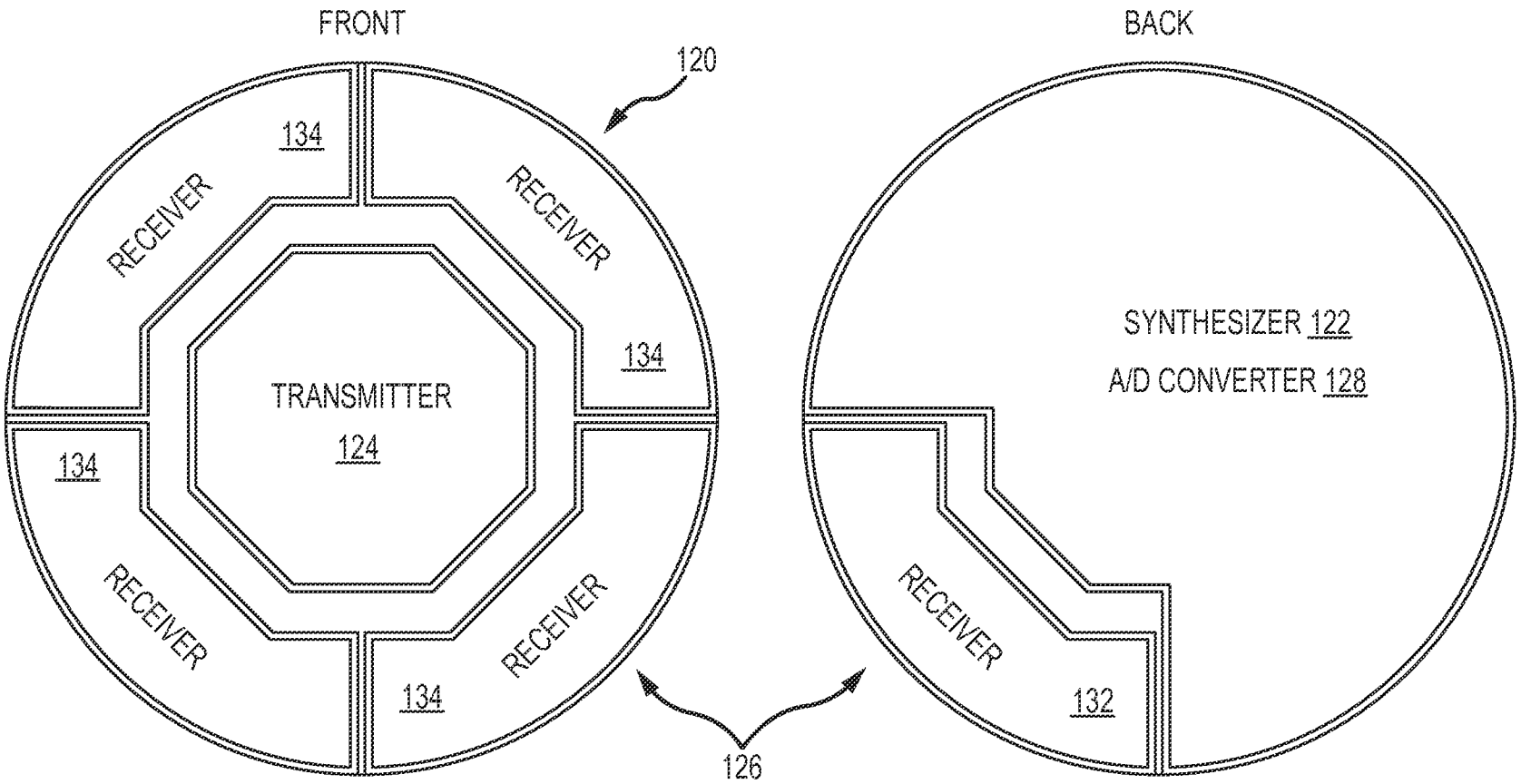
FIGS. 6*a* and 6*b* are front and back views of an embodiment of the MFRF module.

Referring now to FIGS. 6*a* and 6*b*, in an embodiment of a MFRF module 120 at least a frequency synthesizer 122, a transmitter 124, a multi-channel receiver 126 and an analog-to-digital 128 converter are implemented on a single board 130 within the module. The RF signal processor may be implemented on the board or implemented within the guidance module. In this embodiment, a receiver channel 132 coupled to the rear-facing antenna, the synthesizer 122 and the analog-to-digital converter 128 are implemented on an aft-facing side of the board and four receiver channels 134 are implemented around the transmitter 124 on a forward-facing side of the board. The single board may have a diameter of less than 3 inches, which supports a sub-caliber munition for a 5 inch barrel.

In an alternate embodiment, the MFRF module is configurable to select one of a semi-active, active or passive terminal guidance mode. Passive guidance can be used when the target is actively emitting RF energy e.g. a radar installation and a massive in active guidance mode. The receiving and processing for passive guidance is complicated by the fact, unlike the active or semi-active guidance modes, that the munition does not know a priori either the specific frequency or waveform of the RF signal. Such receiver channels and signal processing are known in the art of passive guidance for anti-radiation missiles (ARMs) such as the high-speed ARM (HARM). To support all three modes of terminal guidance, the multi-channel receiver would be designed and configured for the passive guidance mode (e.g. wider bandwidth and waveform discrimination). The passive receiver channel would support either the active or semi-active guidance modes.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A multi-function radio frequency (MFRF) guided munition, comprising:

a munition;

a plurality of airfoils about the munition to stabilize flight;

an explosive warhead on the munition;

at least four forward-facing antennas conformal with the surface of the munition or the airfoils;

at least one rear-facing antenna;

a MFRF module comprising, a frequency synthesizer configured to generate an intermediate frequency (IF) signal;

a transmitter configured to upconvert an input waveform from the IF to an RF frequency and to transmit the RF waveform from one or more of the forward-facing antennas;

a multi-channel analog receiver, each channel coupled to a respective antenna to receive an RF signal and to downconvert the RF signal to an IF signal, amplify the signal and filter noise;

an analog-to-digital converter configured to digitize the IF signals from the multiple receiver channels; and an RF signal processor configured to implement a command-guided mode to process the digital IF signal from the rear-facing antenna and output command guidance information until target acquisition, configurable to implement any one of an active guidance mode in which the transmitter is activated and a semi-active guidance mode to process the digital IF signals from the at least four forward-facing antennas and upon acquisition of the target to derive direction finding information towards the target until terminal, and configurable to implement either of a proximity and height of burst fuze modes by activating the transmitter at terminal and processing the digital IF signal from at least one of the forward-facing antennas to derive range-to-target or Doppler information;

a guidance processor configured to process the direction finding information and output a guidance command; and a control system responsive to the guidance command to maneuver the munition towards the target; and a fuze processor configured to initiate detonation of the warhead.

2. The MFRF guided munition of claim 1, wherein the RF signal processor is configured for selection and storage of the guidance and fuze modes at munition activation just prior to launch.

3. The MFRF guided munition of claim 1, wherein if one of the proximity or height of burst fuze modes are selected, the RF signal processor outputs the Doppler information or range-to-target, respectively, wherein said fuze processor is configured to process the Doppler information or range-to-target to initiate detonation.

4. The MFRF guided munition of claim 1, wherein the RF signal processor is configured in either the active or semi-active guidance modes to implement sum/delta processing on the at least four digital IF signals to derive the direction finding information.

5. The MFRF guided munition of claim 1, wherein the RF signal processor is configurable to implement a passive guidance mode in which the target is actively emitting RF energy, wherein the channels of the multi-channel analog receiver coupled to the at least four forward-facing antennas are configured to receive the actively emitted RF energy to support the passive guidance mode.

6. The MFRF guided munition of claim 1, wherein at least the frequency synthesizer, the transmitter, the multi-channel analog receiver and the analog-to-digital converter are implemented on a single board within the module.

7. The MFRF guided munition of claim 6, wherein a receiver channel, the synthesizer and the analog-to-digital converter are implemented on an aft-facing side of the board and four receiver channels are implemented around the transmitter on a forward-facing side of the board.

8. The MFRF guided munition of claim 1, wherein the munition has a diameter of less than 5 inches.

9. A multi-function radio frequency (MFRF) guided munition, comprising:

a sub-caliber munition having a diameter of less than 5 inches;

a plurality of airfoils deployed about the munition and configured to stabilize flight;

an explosive warhead on the munition;

four forward-facing antennas conformal with the surface of the sub-caliber munition or the airfoils;

a rear-facing antenna;

a MFRF module comprising, a frequency synthesizer configured to generate an intermediate frequency (IF) signal;

a transmitter configured to upconvert an input waveform from the IF to an RF frequency and to transmit the RF waveform from one or more of the forward-facing antennas; and a multi-channel analog receiver, each channel coupled to a respective antenna to receive an RF signal and to downconvert the RF signal to an IF signal, amplify the signal and filter noise;

an analog-to-digital converter configured to digitize the IF signals from the multiple receiver channels;

an RF signal processor configured to implement a command-guided mode to process the digital IF signal from the rear-facing antenna and output command guidance information until target acquisition, configurable to implement any one of an active guidance mode in which the transmitter is activated and a semi-active guidance mode to process the digital IF signals from the four forward-facing antennas and upon acquisition of the target to derive direction finding information towards the target until terminal, and configurable to implement either of a proximity and height of burst fuze modes by activating the transmitter at terminal and processing the digital IF signal from at least one of the forward-facing antennas to derive range-to-target or Doppler information, said RF signal processor configured for selection and storage of the guidance fuze modes at munition activation just prior to launch;

a guidance processor configured to process the direction finding information and output a guidance command; and a control system responsive to the guidance command to maneuver the munition towards the target; and a fuze processor configured to receive one of the Doppler information or range-to-target as a primary fuze mode to initiate detonation of the warhead.

10. The MFRF guided munition of claim 9, wherein the RF signal processor is configured in either the active or semi-active guidance modes to implement sum/delta processing on the at least four digital IF signals to derive the direction finding information.

11. The MFRF guided munition of claim 9, wherein the RF signal processor is configurable to implement a passive guidance mode in which the target is actively emitting RF energy, wherein the channels of the multi-channel analog receiver coupled to the at least four forward-facing antennas are configured to receive the actively emitted RF energy to support the passive guidance mode.

12. The MFRF guided munition of claim 9, wherein at least the frequency synthesizer, the transmitter, the multi-channel analog receiver and the analog-to-digital converter are implemented on a single board within the module.

13. The MFRF guided munition of claim 12, wherein a receiver channel, the synthesizer and the analog-to-digital converter are implemented on an aft-facing side of the board and four receiver channels are implemented around the transmitter on a forward-facing side of the board.

14. A multi-function RF (MFRF) module for providing guidance and fuzing sensors to a gun-launched munition, said MFRF module comprising:

a frequency synthesizer configured to generate an intermediate frequency (IF) signal;

a transmitter configured to upconvert an input waveform from the IF to an RF frequency and to transmit the RF waveform from one or more of the forward-facing antennas; and a multi-channel analog receiver, each channel configured to receive an RF signal from an antenna and to downconvert the RF signal to an IF signal, amplify the signal and filter noise;

an analog-to-digital converter configured to digitize the IF signals from the multiple receiver channels; and an RF signal processor configured to implement a command-guided mode to process the digital IF signal from a rear-facing antenna and output command guidance information until target acquisition, configurable to implement any one of an active guidance mode in which the transmitter is activated and a semi-active guidance mode to process the digital IF signals from at least four forward-facing antennas and upon acquisition of the target to derive direction finding information towards the target until terminal, and configurable to implement either of a proximity and height of burst fuze modes by activating the transmitter at terminal and processing the digital IF signal from at least one of the forward-facing antennas to derive range-to-target or Doppler information.

15. The MFRF module of claim 14, wherein the RF signal processor is configured for selection and storage of the guidance and fuze modes at munition activation just prior to launch.

16. The MFRF module of claim 14, wherein if one of the proximity or height of burst fuze modes are selected, the RF signal processor outputs the Doppler information or range-to-target, respectively.

17. The MFRF module of claim 14, wherein the RF signal processor is configured in either the active or semi-active guidance modes to implement sum/delta processing on the at least four digital IF signals to derive the direction finding information.

18. The MFRF module of claim 14, wherein the RF signal processor is configurable to implement a passive guidance mode in which the target is actively emitting RF energy, wherein the channels of the multi-channel analog receiver coupled to the at least four forward-facing antennas are configured to receive the actively emitted RF energy to support the passive guidance mode.

19. The MFRF module of claim 14, wherein at least the frequency synthesizer, the transmitter, the multi-channel analog receiver and the analog-to-digital converter are implemented on a single board within the module.

20. The MFRF module of claim 19, wherein a receiver channel, the synthesizer and the analog-to-digital converter are implemented on an aft-facing side of the board and four receiver channels are implemented around the transmitter on a forward-facing side of the board.

* * * * *